US008783814B2

(12) United States Patent
Bradley et al.

(10) Patent No.: US 8,783,814 B2
(45) Date of Patent: Jul. 22, 2014

(54) APPARATUS FOR SENSING INDICATORS

(71) Applicant: Hewlett-Packard Development Company, L.P., Houston, TX (US)

(72) Inventors: Mark L. Bradley, Corvallis, OR (US); Timothy M. Souza, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 46 days.

(21) Appl. No.: 13/714,213

(22) Filed: Dec. 13, 2012

(65) Prior Publication Data

US 2014/0168663 A1 Jun. 19, 2014

(51) Int. Cl.
*B41J 29/38* (2006.01)
*B41J 29/393* (2006.01)
*B41J 2/01* (2006.01)

(52) U.S. Cl.
USPC ..... 347/16; 347/19; 347/104

(58) Field of Classification Search
USPC ..... 347/16, 19, 104
See application file for complete search history.

(56) References Cited

U.S. PATENT DOCUMENTS

| | | | | |
|---|---|---|---|---|
| 5,978,635 | A * | 11/1999 | Azuma et al. | 399/283 |
| 6,633,740 | B2 | 10/2003 | Estabrooks | |
| 6,860,478 | B2 | 3/2005 | Hirai | |
| 8,085,448 | B2 | 12/2011 | Kato et al. | |
| 2006/0268346 | A1 | 11/2006 | Van Os | |
| 2008/0190308 | A1 | 8/2008 | Kiwada et al. | |
| 2013/0050379 | A1 * | 2/2013 | Ebina et al. | 347/104 |

* cited by examiner

*Primary Examiner* — Jannelle M Lebron

(57) ABSTRACT

An apparatus for sensing indicators is disclosed herein. An example of the apparatus includes a roller over which a media passes, the roller including a first end that is dark in color and a second end that is light in color. The example of the apparatus also includes a sensor that is moveable between a first position over the first end of the roller and a second position over the second end of the roller. The sensor detects a first indicator on the media in the first position and a second indicator on the media in the second position. An example of a printing device is also disclosed herein. Modifications to and other examples of the apparatus for sensing and printing device are further disclosed herein.

22 Claims, 4 Drawing Sheets

APPARATUS FOR SENSING INDICATORS

BACKGROUND

Printing device users appreciate cost effective solutions for their printing needs. They also appreciate the ability to utilize their printing devices as needed, without incurring losses in production time. Business may, therefore, endeavor to create and provide such printing devices to these users.

BRIEF DESCRIPTION OF THE DRAWINGS

The following detailed description references the drawings, wherein.

DETAILED DESCRIPTION

Some media used in printing devices may include one or more indicators. These indicators are intended to be detected by the printing device during use of such media. Once so detected, a processor of the printing device may utilize these indicators to control processing of the media by the printing device.

A challenge can exist when a media has two or more different types of indicators that must be detected by the printing device. This can require use of separate sensors to detect each of the different types of indicators which can add to the cost and/or complexity of the printing device, neither of which may be desirable. Another potential challenge is possible downtime of a printing device caused by, for example, the added complexity associated with use of such multiple sensors and/or the need to retrofit a printing device with such additional sensors, as well as any associated hardware and/or software.

Figure 1:
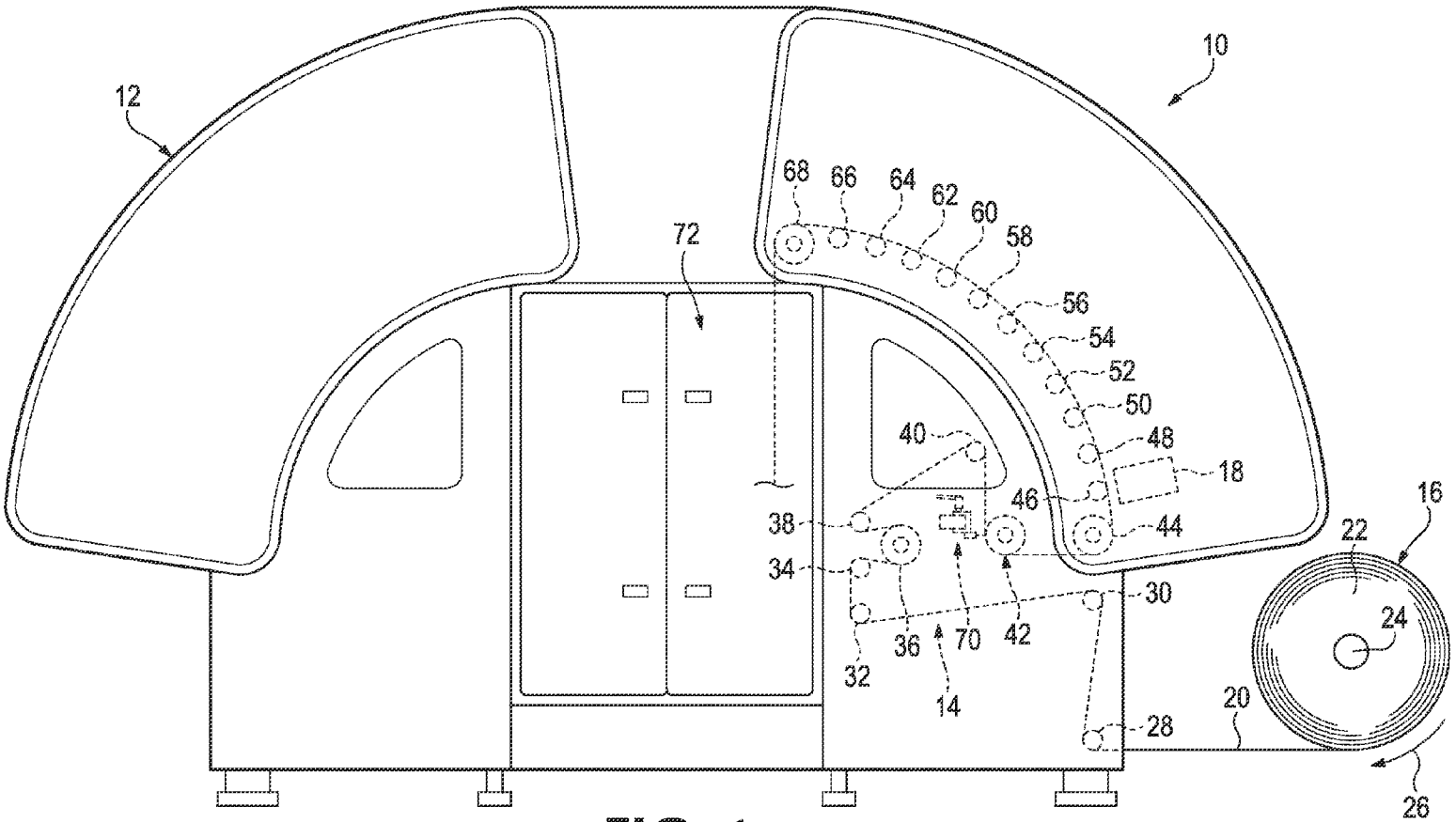
FIG. 1 is an example of a printing device.

An example of a printing device 10 directed to addressing these challenges is illustrated in FIG. 1. As used herein "printing device" is defined as including, but not necessarily being limited to, a press, printer, or plotter that uses any of the following marking technologies or a combination thereof: ink jet, laser jet, dye sublimation, liquid toner, off-set printing, or dot matrix. As used herein "media", "medium", "print media", and "print medium" are defined as including, but not necessarily being limited to, any type of paper or other printing medium (e.g.) cloth, canvas, transparency, etc.), having any type of finish on either or both sides (e.g., glossy, matte, plain, textured, etc.), in any size, shape, color, or form (e.g., sheet, roll (cut or uncut), web, folded, etc.) on which printing composition (e.g., ink, toner, colorant, wax, dye, etc) is placed, jetted, deposited, dropped, or laid to form one or more images (e.g., text, graphics, pictures, formulas, charts, etc.).

As used herein, "printing mechanism" and "print mechanism" are defined as including, but not necessarily being limited to, any of the following marking technologies and associated components, or a combination thereof: ink jet and associated print head(s) (thermal, piezoelectric, etc.), laser jet, dye sublimation, liquid toner, off-set printing, or dot matrix. As used herein, "media control mechanism" is defined as including, but not necessarily being limited to, the gear train, controller, processor, guide(s), nip(s), chute(s) motor(s), encoder(s), and rollers used to advance and control the movement of print media past a printing mechanism of a printing device.

As used herein, "sensor" is defined as including, but not necessarily being limited to, a device and associated electronics that transmit, direct, refract and/or reflect light or other electromagnetic energy toward one or more indicators on or in a print medium and/or detect the quantity or amount of light or other electromagnetic energy reflected from or absorbed by the indicators or an object adjacent to them. The sensor may be an integrated element or composed of separate elements. Additionally, all or part of the sensor may be coupled to or separate from the printing mechanism. As used herein, "indicator" and "indicators" are defined as including, but not necessarily being limited to, a mark, hole, aperture, perforation, pattern, watermark, colorant, fiber, thread, etc. on or in a media.

As used herein, the term "non-volatile storage medium" is defined as including, but not necessarily being limited to, any media that can contain, store, or maintain programs, scripts, information, and/or data. A non-volatile storage medium may include any one of many physical media such as, for example, electronic, magnetic, optical, electromagnetic, or semiconductor media. More specific examples of suitable non-volatile storage media include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

As used herein, the term "processor" is defined as including, but not necessarily being limited to, an instruction execution system such as a computer/processor based system, an Application Specific Integrated Circuit (ASIC), a computing device, or a hardware and/or software system that can fetch or obtain the logic from a non-volatile storage medium and execute the instructions contained therein. "Processor" can also include any controller, state-machine, microprocessor, cloud-based utility, service or feature, or any other analogue, digital and/or mechanical implementation thereof. "Processor" can refer to a single device, as well as a collection or combination of devices.

Referring again to FIG. 1, in this example, printing device 10 is a web press 12 that includes a media control mechanism 14 that advances and controls the movement of print media 16 pasta printing mechanism 18 of printing device 10. As can be seen in FIG. 1, print media 16 is a continuous web of media 20 that is dispensed from a roll of media 22 wound around a shaft, hub, or axle 24. Shaft 24 is mounted on a support mechanism (not shown) so that roll of media 22 rotates in the direction indicated by arrow 26 upon the urging of media control mechanism 14 to dispense continuous web of media 20 to printing device 10.

As can also be seen in FIG. 1, media control mechanism 14 includes a plurality of active drive rollers and passive rollers 28, 30, 32, 34, 36, 38, 40, 42, 44, 46, 48, 50, 52, 54, 56, 58, 60, 62, 64, 66, and 68 that convey and support web 20 of print media 16 from roll 22 to printing mechanism 18. It should be noted that the number and configuration of active drive rollers and passive rollers may differ in other examples of printing device 10. Also, it is to be understood that media control mechanism includes other components and elements as well which are not illustrated in or described in connection with FIG. 1.

As can additionally be seen in FIG. 1, printing mechanism 18 is positioned adjacent the path followed or traversed by web 20 of media 16 through printing device 10. In this example, printing mechanism 18 is illustrated diagrammatically and may include multiple elements or components. It may also include any of a variety of different marking technologies or a combination thereof. Printing mechanism 18 may also be located as shown or in a different location within printing device 10.

As can further be seen in FIG. 1 and discussed more fully below, printing device 10 includes an apparatus 70 for sensing indicators on or in web 20 of media 16. As also discussed more fully below, apparatus 70 may be utilized to detect these indicators in or on web 20 to control processing (e.g., printing or finishing) of print media 16 by printing device 10. As can still further be seen in FIG. 1, web 20 of print media 16 is conveyed to other parts or modules of printing device 10 by media control mechanism 14 subsequent to printing by printing mechanism 18, such as dryer 72.

Although not shown and discussed in detail in connection with FIG. 1, it is to be understood that web press 12 includes additional components and elements that are part of its operation (e.g., a finisher). However, these additional components and elements are not illustrated or discussed because they are not required for an understanding of the structure or operation of apparatus 70 for sensing indicators on or in web 20 of print media 16. Additionally, it is to be understood that one or more of the elements and components of media control mechanism 14 and/or printing mechanism 18 may also not be illustrated or discussed because they are not required for an understanding of the structure or operation of apparatus 70. Furthermore, it is to be understood that in other examples, apparatus 70 may be utilized and deployed in other types of printing devices 10.

Figure 2:
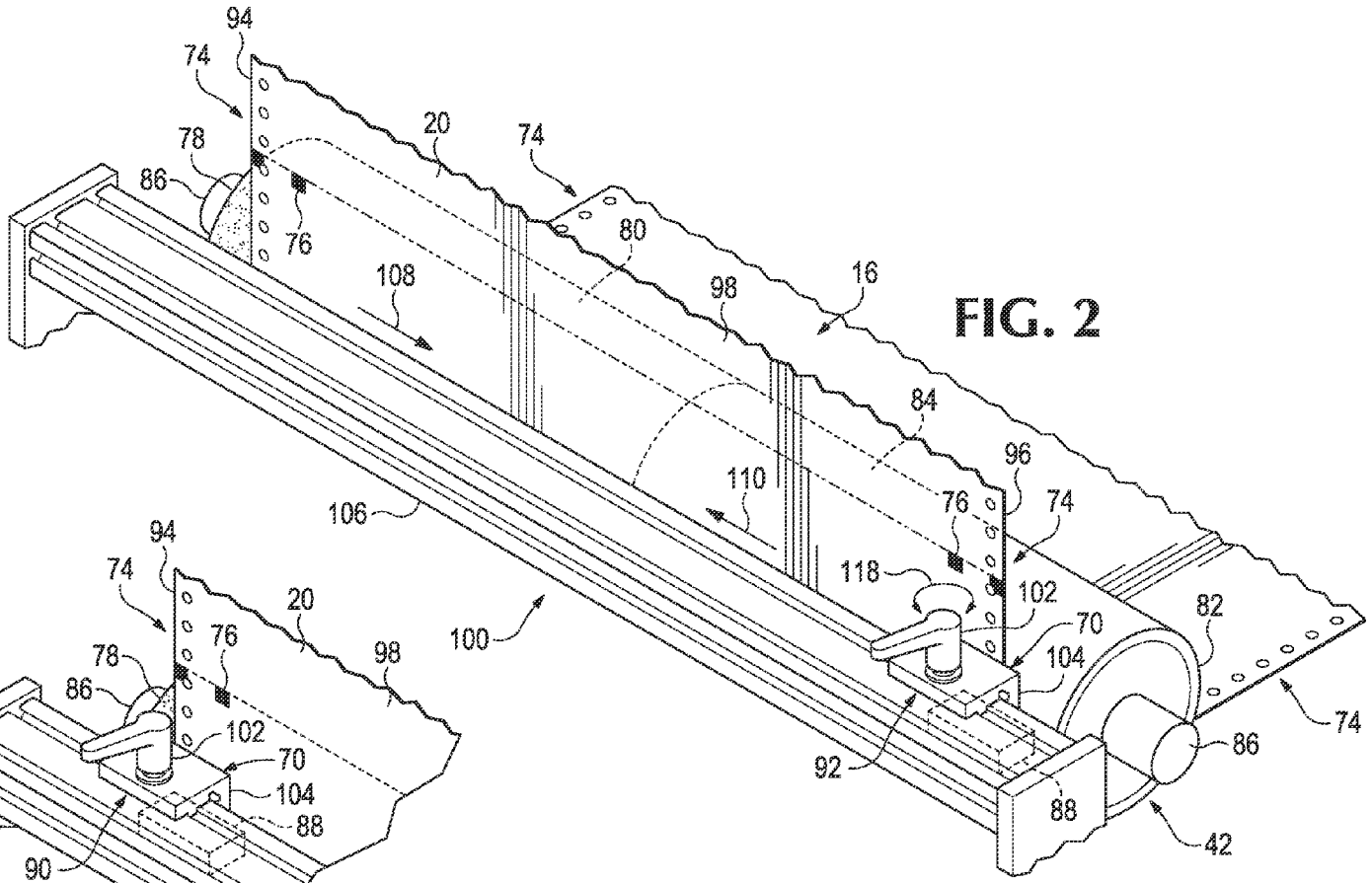
FIG. 2 is a front-side perspective view of an example of an apparatus for sensing indicators on a media.

A front-side perspective view of an example of apparatus 70 for sensing first indicators 74 in web 20 of print media 16 and second indicators 76 on web 20 of print media 16 is shown in FIG. 2. As can be seen in FIG. 2, apparatus 70 includes a roller 42 over which media 16 passes. As can be seen, for example, in the back-side perspective view of apparatus 70 illustrated in FIG. 4, roller 42 includes a first end 78 that is dark in color over a first portion 80 of roller 42 and a second end 82 that is light in color over a second portion 84 of roller 42. As can also be seen, for example, in FIG. 4, roller 42 includes a shaft or axle 86 coupled to printing device 20 on which roller 42 rotates. Roller 42 may passively rotate on axle 86 or be actively driven by shaft 86 to help convey web 20 of print media 16 to printing mechanism 18. In this example, first end 78 is generally black in color and second end 82 is generally white in color. It is to be understood, however, that in other examples of apparatus 70, first end 78 may be a different dark color and/or second end 82 may be a different light color. Additionally, it is to be understood that in other examples of apparatus 70, the relative sizes and extents of respective first and second portions 80 and 84 on roller 42 may be different or varied.

Figure 3:
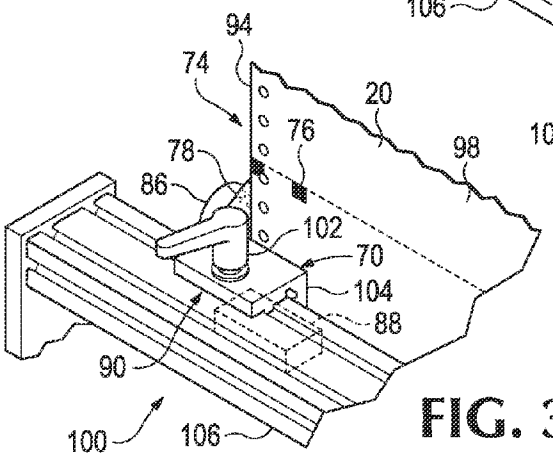
FIG. 3 is a front-side perspective view of an example of a portion of the apparatus for sensing indicators on a media in a different position than that shown in FIG. 2.

Referring again to FIG. 2, apparatus 70 also includes a sensor 88 that is moveable between a first position 90 over first end 78 of roller 42, as shown in FIG. 3, and a second position 92 over second end 82 of roller 42, as shown in FIG. 2. Sensor 88 detects first indicators 74 in web 20 of media 16 in first position 90 and second indicators 76 on web 20 of media 16 in second position 92. In the illustrated example, first indicators 74 include apertures or holes in or defined by web 20 of print media 16 on either side or edge 94 and 96 that continuously extend in a periodic manner along the length of web 20 of print media 16. Also in the illustrated example, second indicators 76 include top-of-form (ToF) marks on either side or edge 94 and 96 of web 20 of print media 16 that continuously extend in a different periodic manner along the length of web 20 of print media 16.

Although not shown, it is to be understood that in other examples of apparatus 70, respective first andlor second indicators 74 and 76 may be different. For example, first indicator 74 may be a differently shaped aperture and second indicator 76 may be a watermark, rather than a ToF mark. Additionally or alternatively, respective first and/or second indicators 74 and 76 may positioned at different locations than sides 94 and 96 of web 20 of print media 16. For example, either or both of respective first and/or second indicators 74 and 76 may be located along width 98 of web 20 of print media 16. Furthermore, in other examples, the repeating periodicity of either or both respective first and second indicators 74 and 76 may be different than as illustrated.

As can additionally be seen in FIG. 2, apparatus 70 includes a rail assembly 100 on which sensor 88 is movably mounted between first position 90 illustrated in FIG. 3 and the second position 92 illustrated FIG. 2. In this example, as discussed more fully below, sensor 88 is manually movable between first position 90 and second position 92 by loosening handle 102 of rail assembly 100 and translating shuttle 104 of rail assembly 100 to which sensor 88 is attached along rail 106 in either the direction of arrow 108 to move from first position 90 to second position 92 or arrow 110 to move from second position 92 to first position 90. Once shuttle 104 has been manually repositioned, handle 102 may be tightened to secure sensor 88 in either the first position 90 or the second position 92.

Figure 4:
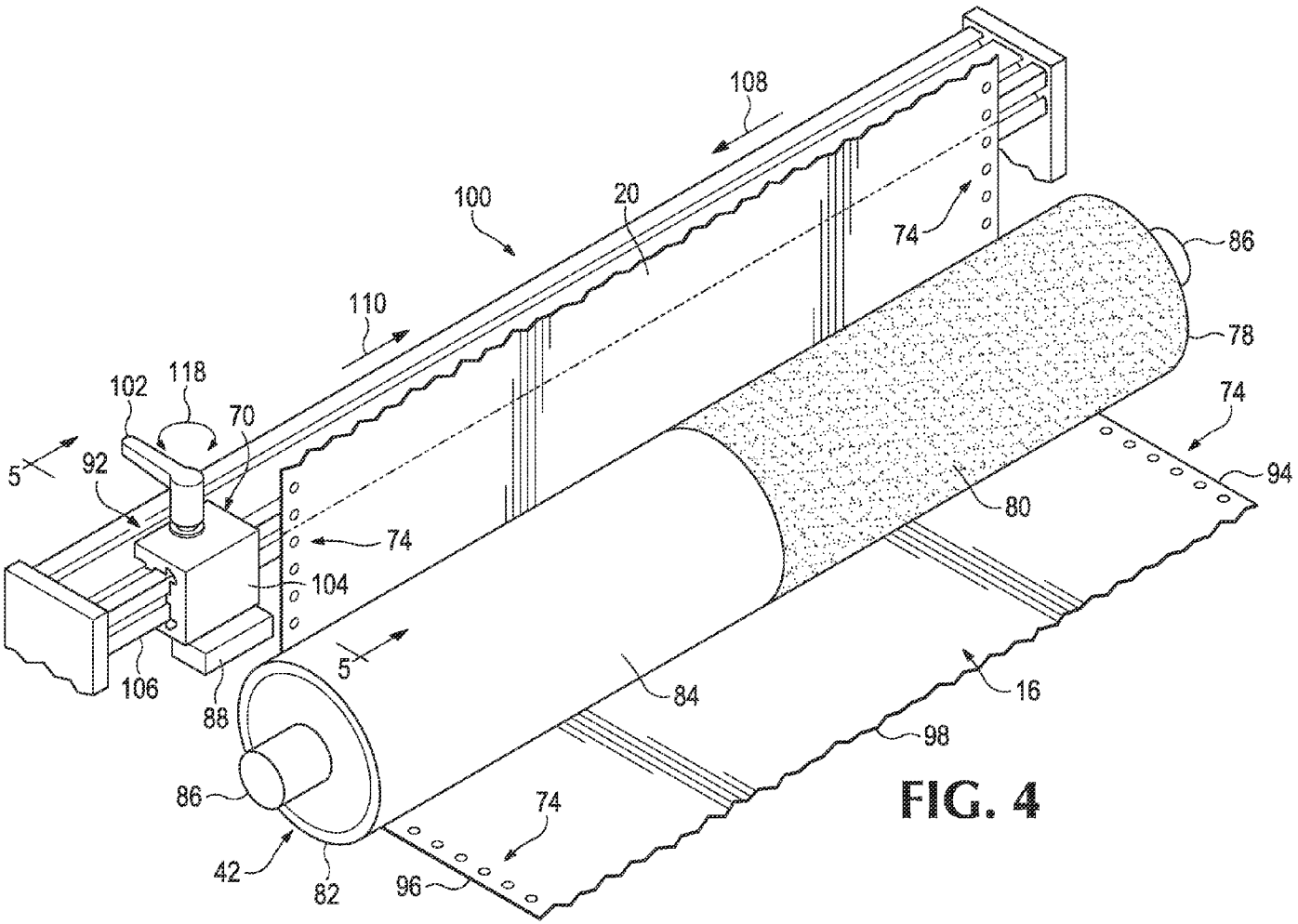
FIG. 4 is a back-side perspective view of an example of the apparatus for sensing indicators on a media.
Figure 5:
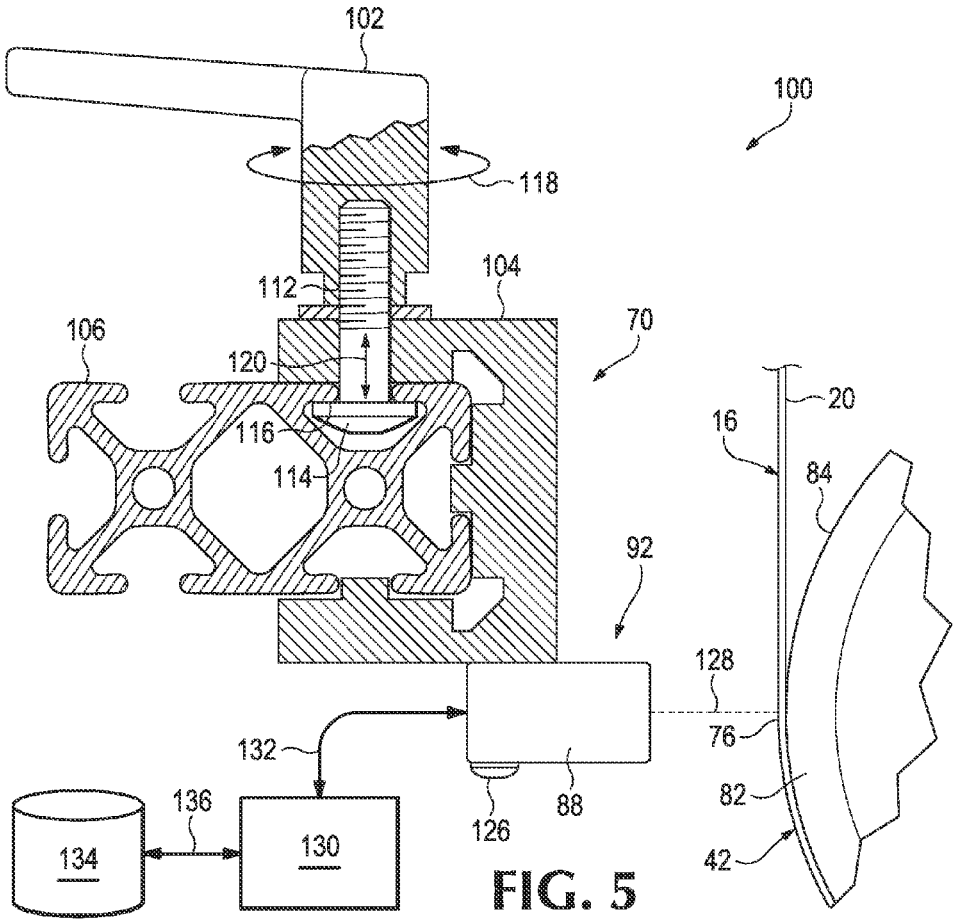
FIG. 5 is a cross-sectional view taken along line 5-5 of FIG. 4.

A cross-sectional view of apparatus 70 taken along tine 5-5 of FIG. 4 is shown in FIG. 5. As can be seen in FIG. 5, rail assembly 100 includes a fastener 112 that is coupled to handle 102. Fastener 112 includes a head 114 that is disposed in track 116 of rail 106. Movement of handle 102 in the clockwise direction of double-headed arrow 118 causes head 114 of fastener 112 to move in the downward direction of double-headed arrow 120 away from its engagement with track 116 of rail 106. This allows shuttle 104 of rail assembly 100 to then be manually translated in the direction of arrow 110 (see FIG. 2) from second position 92 to first position 90. Once repositioned, movement of handle 102 in the counter-clockwise direction of double-headed arrow 118 causes head 114 of fastener 112 to move in the upward direction of double-headed arrow 120 toward engagement with track 116 of rail 106, thereby securing shuttle 104 and sensor 88 in position. As can be seen in FIG. 5, in this example, sensor 88 is attached to shuttle 104 by a fastener 126.

As can also be seen in FIG. 5, sensor 88 detects indicator 76 on web 20 of media 16 in second position 92 based on light 128 reflected from indicator 76. Sensor 88 may transmit light toward web 20 of media 16, a portion of which is reflected from indicator 76 as tight 128, or reflected light 128 may be transmitted from a different source (not shown) or the ambient environment. Although not shown in FIG. 5, it is to be understood that sensor 88 may also be utilized to detect one or more indicators 74 in web 20 of print media 16 in first position 90 based on light reflected from first end 78 of roller 42 adjacent indicators 74.

A processor 130 is coupled to sensor 88, as generally indicated by double-headed arrow 132, to receive data from sensor 88 regarding detection of indicators 74 and 76. Processor 130 may also control operation of sensor 88 (e.g., transmission of light toward indicators 74 and 76). As can additionally be seen in FIG. 5, apparatus 70 may additionally include a non-volatile storage medium 134 coupled to processor 130, as generally indicated by double-headed arrow 136. Non-volatile storage medium 134 may include instructions that, when executed by processor 130, control operation of processor 130 and/or apparatus 70. Additionally, processor 130 may store data regarding detection of indicators 74 and 76 on non-volatile storage medium 134.

Figure 6A:
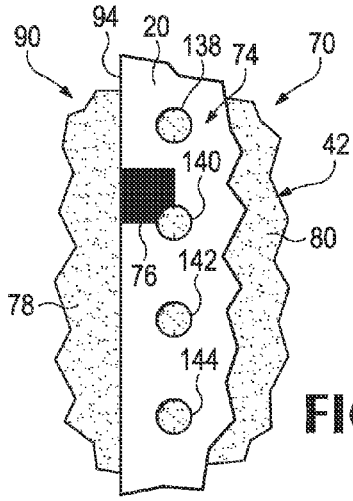
FIG. 6A is an enlarged view of a portion of the apparatus for sensing indicators in a media.

An enlarged view of a portion of apparatus 70 for sensing indicator 74 in web 20 of print media 16 in first position 90 is shown in FIG. 6A. As can be seen in FIG. 6A, the dark color of first portion 80 of roller 42 at first end 78 helps highlight the apertures or holes 138, 140, 142, and 144 of indicator 74 making them highly visible to sensor 88. This contrast helps sensor 88 detect holes or apertures 138, 140, 142, and 144 of indicator 74 in web 20 of print media 16 in first position 90 based on light reflected from first portion 80 at first end 78 of roller 42 adjacent indicators 74. Processor 130 (see FIG. 5) may count holes or apertures 138, 140, 142, and 144 of indicator 74 to control processing of media 16.

As can also be seen in FIG. 6A, the dark color of first portion 80 of roller 42 at first end 78 helps to obscure indicator 76 by making it less visible to sensor 88 due to the similarity of color between this dark color and the color of indicator 76. Processor 130 (see FIG. 5) can thus more easily mask indicator 76 and concentrate instead on apertures or holes 138, 140, 142, and 144 of indicator 74.

Figure 6B:
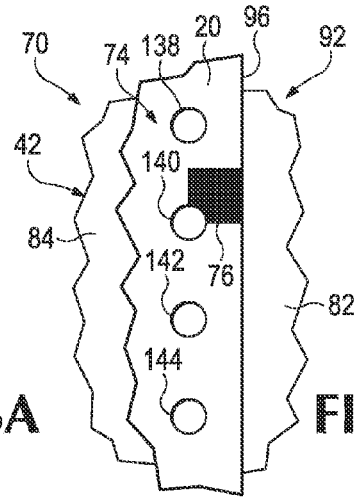
FIG. 6B is an enlarged view of a different portion of the apparatus for sensing indicators on the media.

An enlarged view of a different portion of the apparatus 70 for sensing indicators 76 on the web 20 of print media 16 in second position 92 is shown in FIG. 6B. As can be seen in FIG. 6B, the light color of second portion 84 of roller 42 at second end 82 helps highlight indicator 76 making it highly visible to sensor 88. This contrast helps sensor 88 detect indicator 76 on web 20 of print media 16 in first position 92 based on light reflected from indicator 76. Processor 130 (see FIG. 5) may utilize this detection of indicator 76 to control processing of media 16.

As can also be seen in FIG. 6B, the light color of second portion 84 of roller 42 at second end 82 helps to obscure or mask apertures or holes 138, 140, 142, and 144 of indicator 74 by making them less visible to sensor 88 due to the similarity of color between this light color and the color of web 20 of print media 16. Processor 130 (see FIG. 5) can thus more easily mask indicator 74 and concentrate instead on indicator 76.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, in other examples of apparatus 70, sensor 88 may be mechanically moved by, for example, a drive assembly, rather than manually via a rail assembly 100, as shown. The spirit and scope of the present invention are to be limited only by the terms of the following claims.

Additionally, reference to an element in the singular is not intended to mean one and only one, unless explicitly on stated, but rather means one or more. Moreover, no element or component is intended to be dedicated to the public regardless of whether the element or component is explicitly recited in the following claims.

What is claimed is:

1. An apparatus for sensing indicators, comprising:

a roller over which a media passes, the roller including a first end that is dark color and a second end that is light color; and a sensor that is moveable between a first position over the first end of the roller and a second position over the second end of the roller, the sensor detecting a first indicator in the media in the first position and a second indicator on the media in the second position.

2. The apparatus of claim 1, wherein the sensor is manually moveable between the first position and the second position.

3. The apparatus of claim 1, further comprising a printing device.

4. The apparatus of claim 1, wherein the roller helps to convey the media to a printing mechanism.

5. The apparatus of claim 1, wherein the media is a web.

6. The apparatus of claim 1, wherein the first indicator includes a plurality of apertures in the media.

7. The apparatus of claim 6, further comprising a processor that counts the apertures in the media and utilizes this count to control processing of the media.

8. The apparatus of claim 1, wherein the sensor detects the first indicator in the media in the first position based on light reflected from the first end of the roller adjacent the first indicator.

9. The apparatus of claim 8, wherein the sensor transmits light toward the media in the first position.

10. The apparatus of claim 1, wherein the sensor detects the second indicator on the media in the second position based on light reflected from the second indicator.

11. The apparatus of claim 10, wherein the sensor transmits light toward the media in the second position.

12. A printing device, comprising:

a printing mechanism that deposits printing composition on a media;

a roller including a first end that is dark in color and a second end that is light in color;

a support assembly adjacent the roller; and a sensor moveably mounted on the support assembly between a first position over the first end of the roller and a second position over the second end of the roller, the sensor detecting a first indicator in the media in the first position and a second indicator on the media in the second position.

13. The printing device of claim 12, wherein the media passes over the roller.

14. The printing device of claim 12, wherein the support assembly includes a rail.

15. The printing device of claim 12, wherein the roller helps to convey the media to a printing mechanism.

16. The printing device of claim 12, wherein the media is a web.

17. The printing device of claim 12, wherein the first indicator includes a plurality of apertures in the media.

18. The printing device of claim 17, further comprising a processor that counts the apertures in the media and utilizes this count to control printing on the media by the printing mechanism.

19. The printing device of claim 12, wherein the sensor detects the first indicator in the media in the first position based on light reflected from the first end of the roller adjacent the first indicator.

20. The printing device of claim 19, wherein the sensor transmits light toward the media in the first position.

21. The printing device of claim 12, wherein the sensor detects the second indicator on the media in the second position based on light reflected from the second indicator.

22. The printing device of claim 21, wherein the sensor transmits light toward the media in the second position.

* * * * *